US006217374B1

(12) United States Patent
O'Sullivan

(10) Patent No.: US 6,217,374 B1
(45) Date of Patent: Apr. 17, 2001

(54) ELECTRICAL CONNECTOR WITH WIRE MANAGEMENT SYSTEM

(75) Inventor: Michael O'Sullivan, Willowbrook, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/442,907

(22) Filed: Nov. 18, 1999

(51) Int. Cl.[7] ..... H01R 12/24
(52) U.S. Cl. ..... 439/499; 439/494
(58) Field of Search ..... 439/492, 494, 439/499, 579

(56) References Cited

U.S. PATENT DOCUMENTS

| | | | | |
|---|---|---|---|---|
| 3,573,719 | * | 4/1971 | Lightner | 439/494 |
| 3,634,806 | * | 1/1972 | Fergusson | 439/494 |
| 4,083,615 | * | 4/1978 | Volinskie | 439/494 |
| 4,758,182 | | 7/1988 | Anbo et al. | 439/592 |
| 5,052,104 | | 10/1991 | Tran | 29/861 |
| 5,211,578 | * | 5/1993 | Henschen et al. | 439/492 |
| 5,267,874 | | 12/1993 | Koegel et al. | 439/497 |
| 5,267,875 | | 12/1993 | Koegel et al. | 439/497 |
| 5,554,055 | | 9/1996 | Miller | 439/752 |
| 5,643,010 | | 7/1997 | Wu | 439/598 |
| 5,667,401 | * | 9/1997 | Kuwabara et al. | 439/494 |
| 5,906,511 | * | 5/1999 | Bozzer et al. | 439/579 |
| 5,980,308 | * | 11/1999 | Hu et al. | 439/579 |

FOREIGN PATENT DOCUMENTS

WO 97/26004 11/1994 (WO) .

* cited by examiner

*Primary Examiner*—Paula Bradley
*Assistant Examiner*—Tho D. Ta
(74) *Attorney, Agent, or Firm*—Robert J. Zeitler

(57) ABSTRACT

An electrical connector includes an elongated dielectric housing having a central body portion with a front face, a rear face and at least three rows of terminal-receiving passages extending therebetween and including a top row, a middle row and a bottom row. A plurality of terminals are received in the passages and include top terminals received in at least some of the passages in the top row, middle terminals received in at least some of the passages in the middle row and bottom terminals received in at least some of the passages in the bottom row. All of the terminals have forward contact portions and tail portions projecting rearwardly from the body portion beyond the rear face thereof. The tail portions of the middle terminals are longer than the tail portions of the top terminals. A wire management platform projects from the rear face of the central body portion and includes a first top surface at which the tail portions of the top terminals are juxtaposed. A second top surface of the platform is offset from the first top surface and projects further from the rear face of the body portion than the first top surface and at which the longer tail portions of the middle terminals are juxtaposed. The platform includes a bottom surface at which the tail portions of the bottom terminals are juxtaposed.

19 Claims, 9 Drawing Sheets

ELECTRICAL CONNECTOR WITH WIRE MANAGEMENT SYSTEM

FIELD OF THE INVENTION

This invention generally relates to the art of electrical connectors and, particularly, to a connector having a wire management means for facilitating terminating the conductors of a plurality of electrical wires to the terminating portions of the connector terminals.

BACKGROUND OF THE INVENTION

A known type of input/output (I/O) electrical connector includes an elongated dielectric housing having a front mating face and a rear face with a plurality of terminal-receiving passages extending therebetween. The faces extend longitudinally between opposite ends of the elongated housing. A plurality of terminals are received in the passages. Each terminal includes a forwardly projecting contact portion and a tail portion projecting rearwardly from the housing beyond the rear face thereof. The tail portions typically are inserted into holes in a printed circuit board, surface mounted to circuit traces on a circuit board or connected directly to the center conductors of discrete electrical wires.

With the ever-increasing miniaturization of the electronics in various industries, such as in the computer and telecommunications industries, along with the accompanying miniaturization of electrical connectors, considerable problems have been encountered in terminating miniature terminals, particularly the terminal tails. This is particularly true when the tail portions of the terminals are terminated to "loose" or freely movable electrical wires (versus more stationary circuit traces of a generally rigid circuit board). This problem of terminating the tiny terminal tails to the conductors of discrete electrical wires is magnified or compounded when the terminals are mounted in the connector housing in a plurality of closely spaced rows which is typical in many known I/O electrical connectors. The present invention is directed to solving these problems by providing a unique wire management system in such an electrical connector.

SUMMARY OF THE INVENTION

An object, therefore, of the invention is to provide a new and improved electrical connector of the character described, including a wire management means for facilitating termination of the tail portions of a plurality of terminals to the conductors of a plurality of electrical wires, particularly when the terminals are mounted in rows in the connector housing.

In the exemplary embodiment of the invention, the connector includes an elongated dielectric housing having a central body portion with a front face, a rear face and three rows of terminal-receiving passages extending therebetween and including a top row, a middle row and a bottom row. A plurality of terminals are received in the passages and include top terminals received in at least some of the passages of the top row, middle terminals received in at least some of the passages of the middle row and bottom terminals received in at least some of the passages of the bottom row. All of the terminals have forward contact portions and tail portions projecting rearwardly from the body portion beyond the rear face thereof. The tail portions of the middle terminals are longer than the tail portions of the top terminals.

The invention contemplates a wire management platform projecting from the rear face of the central body portion. The platform includes a first top surface at which the tail portions of the top terminals are juxtaposed. A second top surface is offset from the first top surface and projects further from the rear face of the body portion than the first top surface and at which the longer tail portions of the middle terminals are juxtaposed. A bottom surface is provided at which the tail portions of the bottom terminals are juxtaposed. The three distinct surfaces facilitate connection of the tail portions of the terminals to the conductors of a plurality of appropriate electrical wires.

As disclosed herein, a plurality of grooves are provided in at least one of the platform surfaces, aligned with the tail portions juxtaposed thereat. The grooves facilitate aligning the electrical wires and respective conductors with the tail portions of the terminals.

According to another aspect of the invention, a wire management platform may include a first top surface and an offset, longer second top surface for use in a connector having only two rows of terminals, with the tail portions of the bottom row being longer than the tail portions of the top row. According to a further aspect of the invention, a wire management platform for a single row of terminals may include grooves for aligning the conductors of the wires with the tail portions of the terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
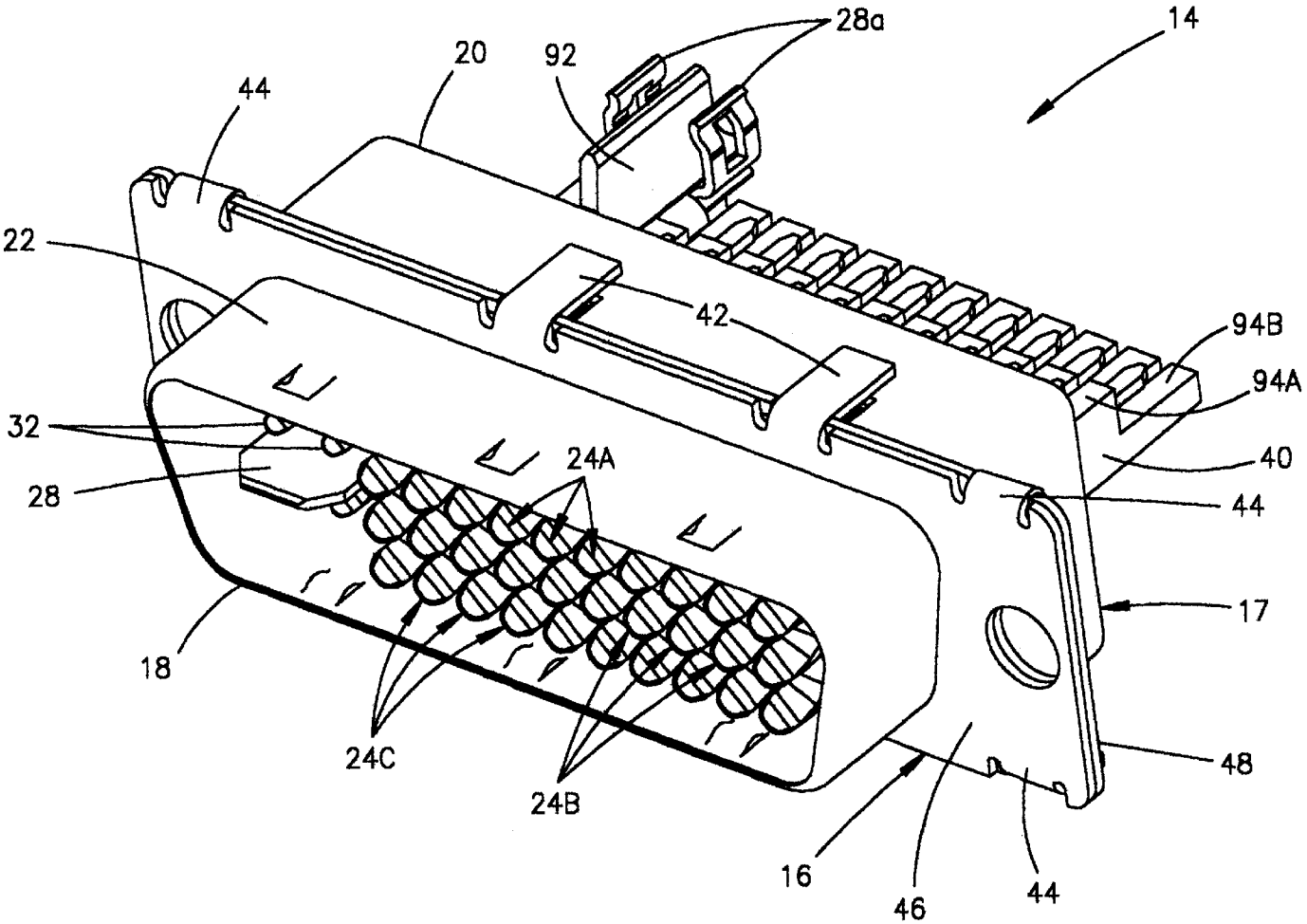
FIG. 1 is a perspective view of an electrical connector embodying the concepts of the invention.
Figure 2:
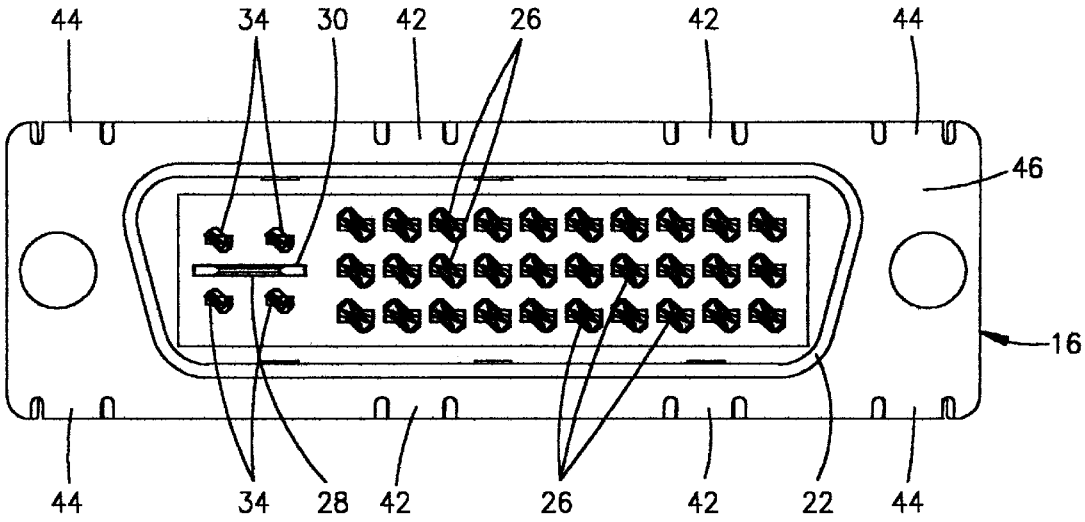
FIG. 2 is a front elevational view of the connector.
Figure 3:
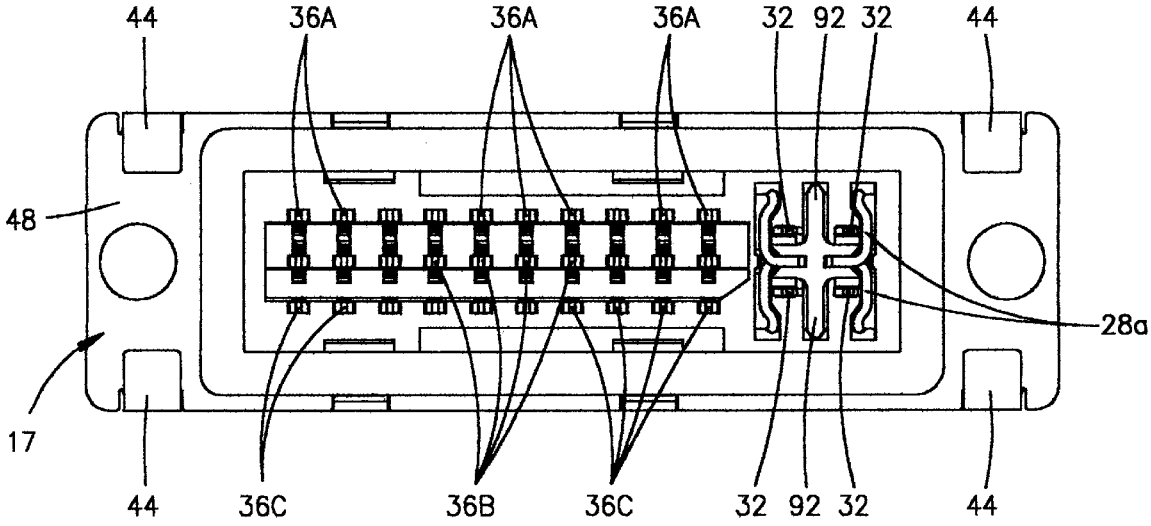
FIG. 3 is a rear elevational view of the connector.

Referring to the drawings in greater detail, and first to FIGS. 1–5, the invention is embodied in an electrical connector, generally designated 14, which includes an inner dielectric housing (described hereinafter) substantially surrounded by a front shield, generally designated 16, and a back shield, generally designated 17. Each of the shields 16 and 17 is a one-piece structure stamped and formed of conductive sheet metal material.

The connector is an input/output (I/O) electrical device wherein front shield 16 defines a front mating face 18 of the connector, and rear shield 17 defines a rear terminating face 20. The front face actually is formed by a shroud portion 22 of shield 16 surrounding forwardly projecting contact portions of three rows of data transmission terminals. The top row of terminals are generally designated 24A; the middle row of terminals are generally designated 24B; and the bottom row of terminals are generally designated 24C. The data transmission terminals project through terminal-receiving passages 26 (FIG. 2) in the connector housing. It should be noted in FIGS. 1 and 2 that terminals are not inserted into all of the passages in the all of the rows. The terminal configuration or array is determined by the particular specifications or application of the connector.

A conductive ground blade 28 projects through a blade-receiving passage 30 (FIG. 2) in the connector housing. A pair of high speed signal terminals 32 (FIGS. 1 and 3) project through a pair of terminal-receiving passages 34 (FIG. 2) in the housing on each opposite side of ground blade 28. Terminating tail portions 34*c* (FIG. 4) of the high speed signal terminals 32 project rearwardly of rear shield 17. The top row of terminals 24A have tail portions 36A projecting rearwardly of the shield. The middle of terminals 24B have tail portions 36B (FIGS. 4 and 5) projecting rearwardly of the rear shield. The bottom row of terminals 24C have tail portions 36C (FIG. 5) projecting rearwardly of the rear shield. All of the tail portions of all of the terminals project rearwardly of rear shield 17 on a rear wire management platform 40 of the connector housing.

At this point, it should be understood that the use of the terms "top", "bottom" and "middle" herein and in the claims hereof is not in any way intended to be limiting. These terms are used herein to provide a clear and concise understanding of the invention. Electrical connector 14 is omnidirectional in use and such terms are used basically in reference to the depiction or orientation in the drawings to best understand the invention.

Front shield 16 has a pair of rearwardly formed tabs 42 on both the top and bottom thereof to embrace the housing as will be seen hereinafter. Four rearwardly formed tabs 44 are bent from a base plate 46 of front shield 16 over a base plate 48 of rear shield 17 to secure the front and rear shields about the connector housing.

Figure 6:
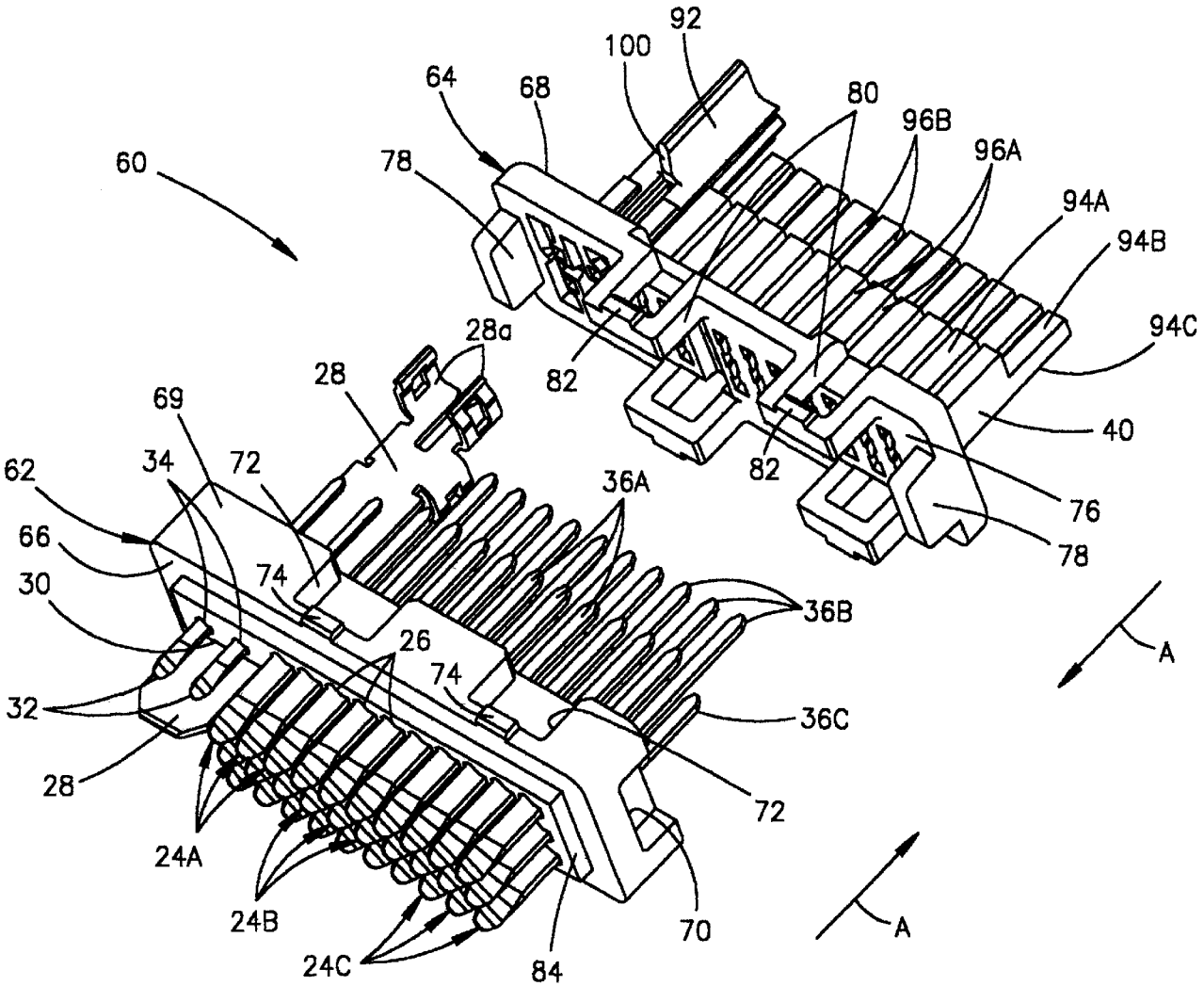
FIG. 6 is an exploded perspective view of the two-part housing with the terminals and ground blade mounted in the front housing part.
Figure 7:
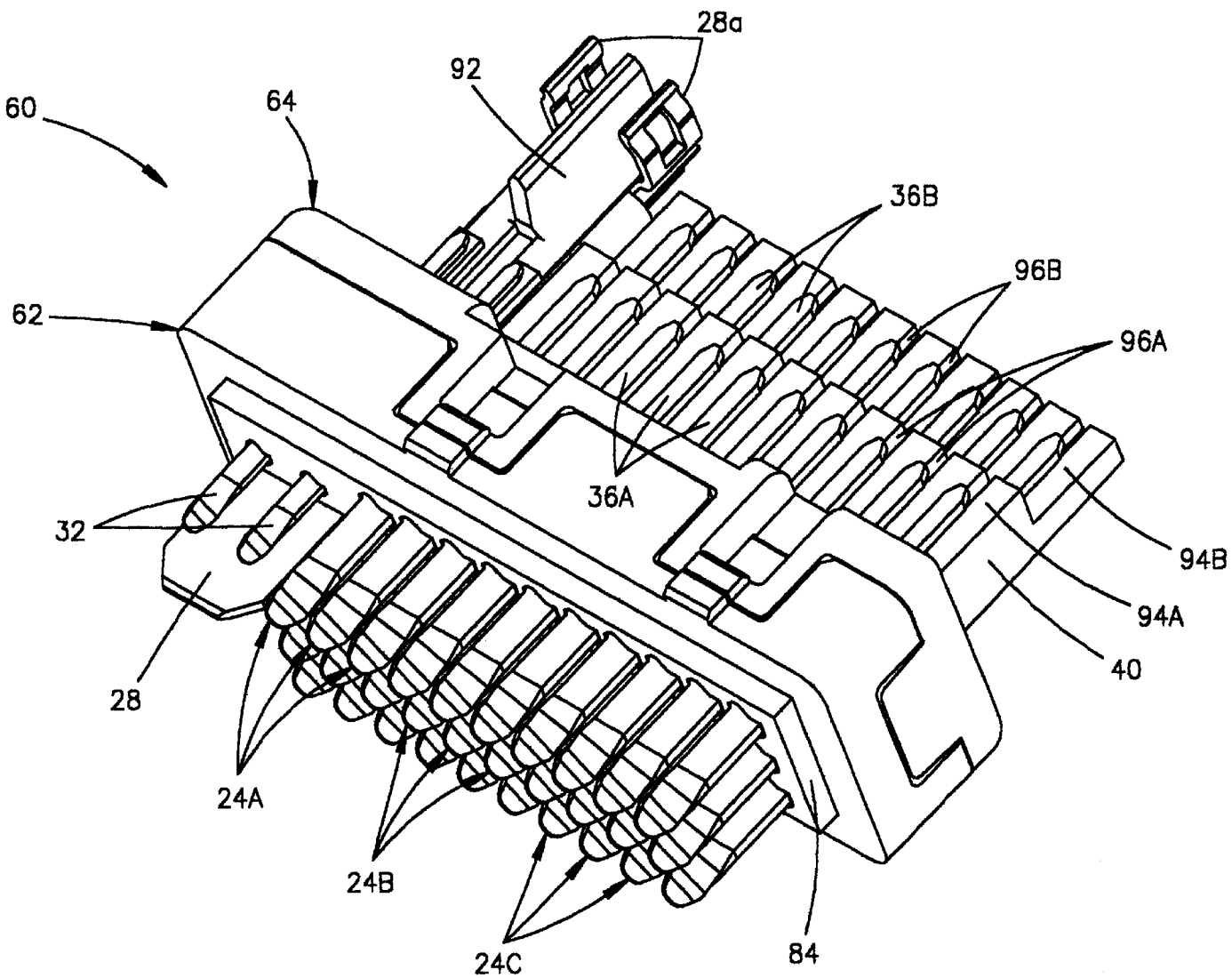
FIG. 7 is a perspective view of the two-part housing in assembled condition.

Referring to FIGS. 6 and 7, connector 14 includes a two-part dielectric housing, generally designated 60, which is formed of a front housing or housing part, generally designated 62, and a rear housing or housing part, generally designated 64. The front housing part defines a front mating end 66 of the housing, and the rear housing part defines a rear end 68 of the housing. The front housing part includes a central body portion 69 which includes terminal-receiving passages 26 for data transmission terminals 24A–24C, terminal-receiving passages 34 for high speed signal terminals 32 and blade-receiving passage 30 for receiving ground blade 28. Tail portions 36A–36C of the data transmission terminals and tail portions 32*c* of the signal terminals project rearwardly of front housing part 62. The rear end of ground blade 28 also projects rearwardly of the front housing part. The front housing part has end recesses 70 and top and bottom recesses 72, along with upwardly and downwardly projecting tabs 74, for purposes described hereinafter.

Rear housing part 64 includes a central body portion 76 for abutting against the rear of front housing part 62 when the housing parts are assembled in the direction of arrows "A" (FIG. 6). The rear housing part has side wings 78 and top and bottom wings 80 which move into recesses 70 and 72, respectively, of the front housing part when the two housing parts are assembled as shown in FIG. 7. Rear housing part 64 also has upwardly and downwardly projecting tabs 82 which become juxtaposed with tabs 74 of the front housing part when assembled.

Figure 8:
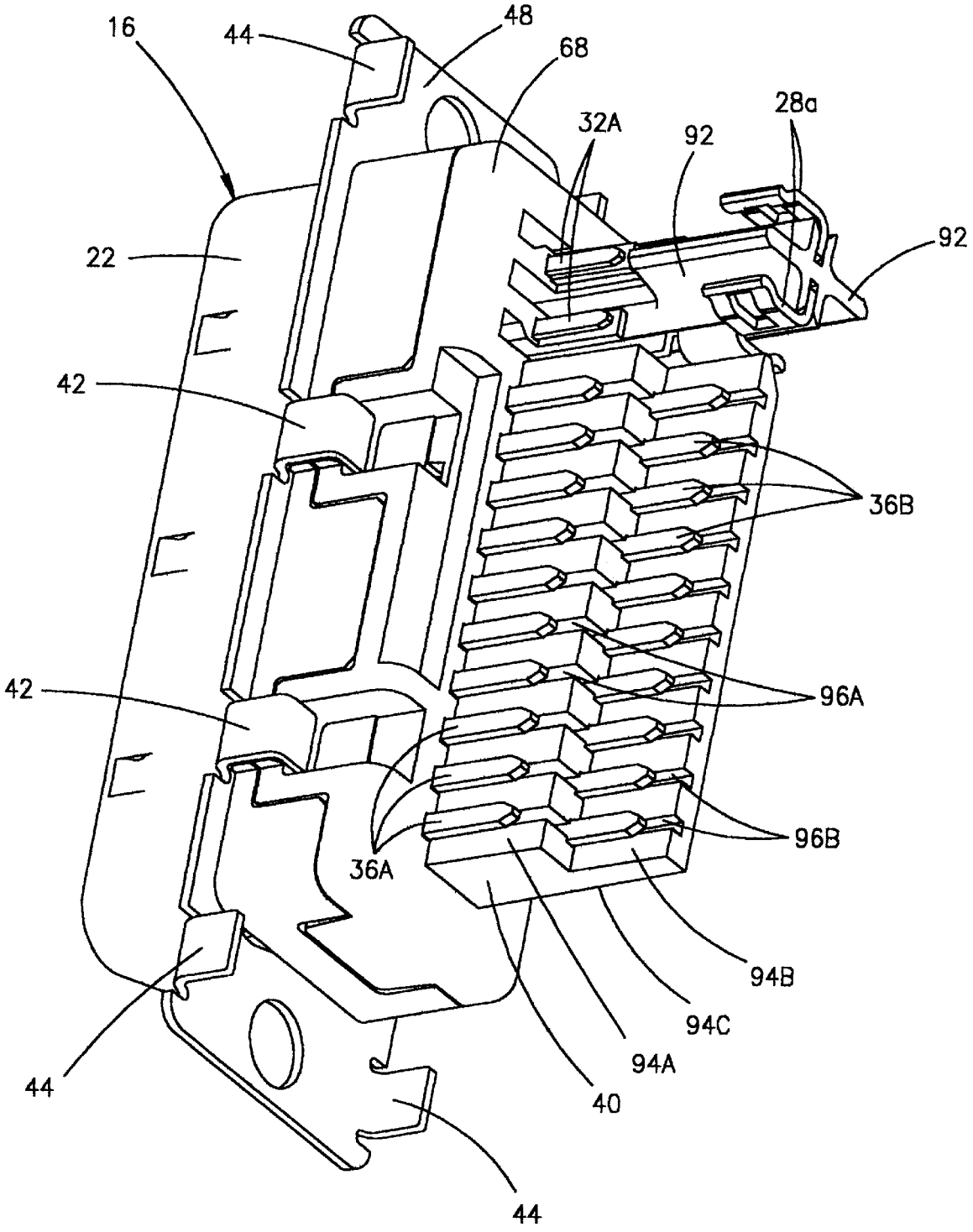
FIG. 8 is a rear perspective view showing the front shield assembled to the two-part housing.
Figure 9:
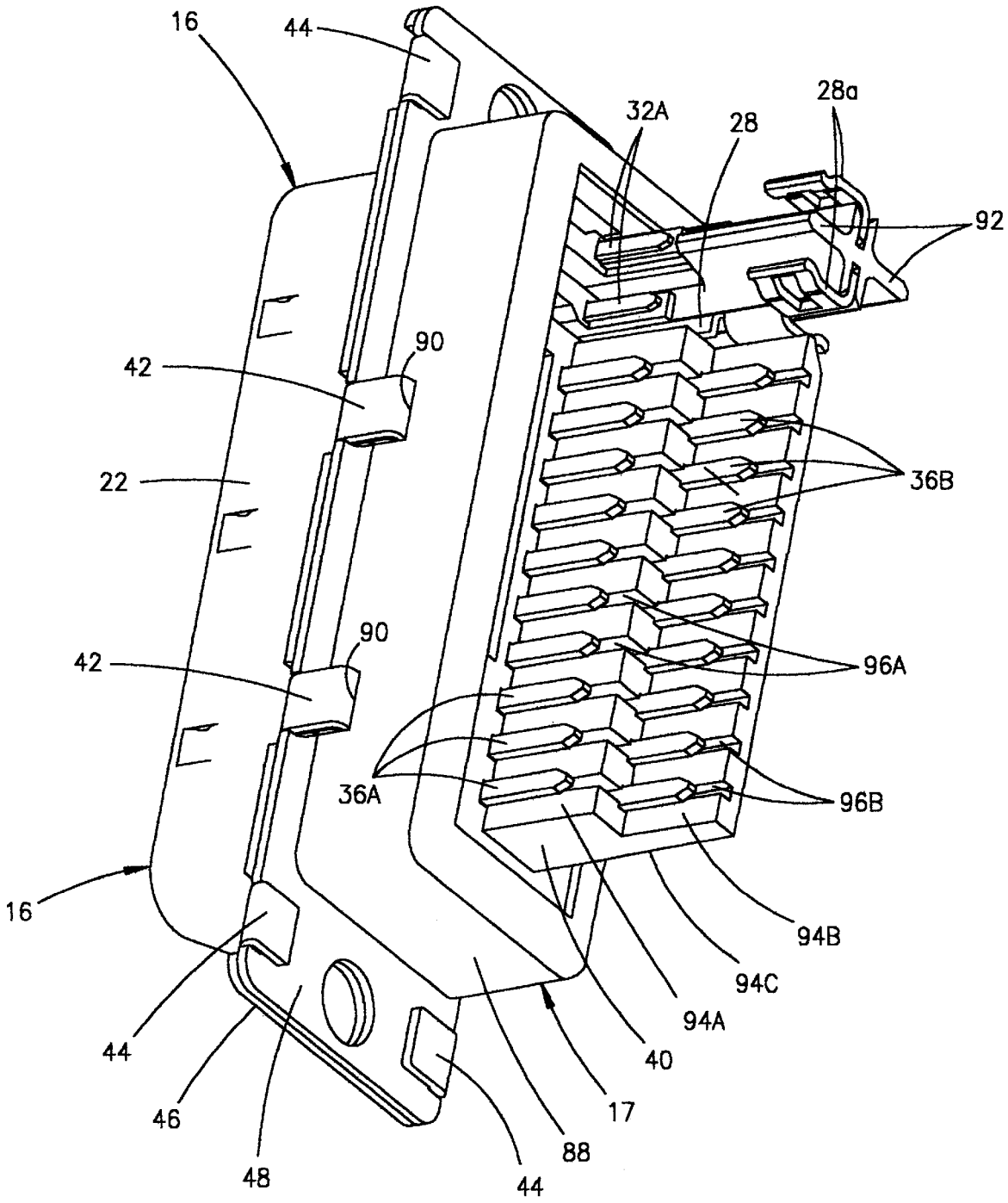
FIG. 9 is a perspective view similar to that of FIG. 8, with the rear shield fully assembled.

After data transmission terminals 24A–24C, high speed signal terminals 32 and ground blade 28 are mounted in front housing part 62, and rear housing part 64 is juxtaposed against the front housing part, the front and rear shields of the connector are assembled to complete the assembly of the connector as shown in FIGS. 8 and 9. More particularly, as seen in FIG. 8, the subassembly of the two-part housing 60, the data transmission terminals, the high speed signal terminals and the ground blade are assembled to front shield 16. A forwardly projecting portion 84 of the front housing part is properly positioned within shroud 22 of the front shield. Tabs 42 at the top and bottom of base plate 46 of the front shield then are bent into recesses 86 in the top and bottom of rear housing part 64, about tabs 74 and 82 (FIGS. 6 and 7) of the front and rear housing parts, respectively. Therefore, tabs 42 of the front shield are effective to not only hold the front shield to housing 60, but to hold the two housing parts 62 and 64 together.

Rear shield 17 then is assembled as shown in FIG. 9. The rear shield has a shroud 88 which substantially surrounds the two-part housing, except for rearwardly extending wire management platform 40 of the rear housing. Shroud 88 has apertures 90 for accommodating rearwardly formed tabs 42 of the front shield. In final assembly, tabs 44 of the front shield are bent or formed around the back side of base plate 48 of the rear shield to hold the two shields together and the connector in fully assembled condition.

FIGS. 8 and 9 best show that ground blade 28 has a pair of positioning arms 28*a* which project from each opposite side of the ground blade at a rear terminating end thereof. The rear housing has partitions 92 which project between each pair of positioning arms to form four quadrants for receiving four coaxial cables for termination to tail portions 32*a* of high speed signal terminals 32.

Figure 10:
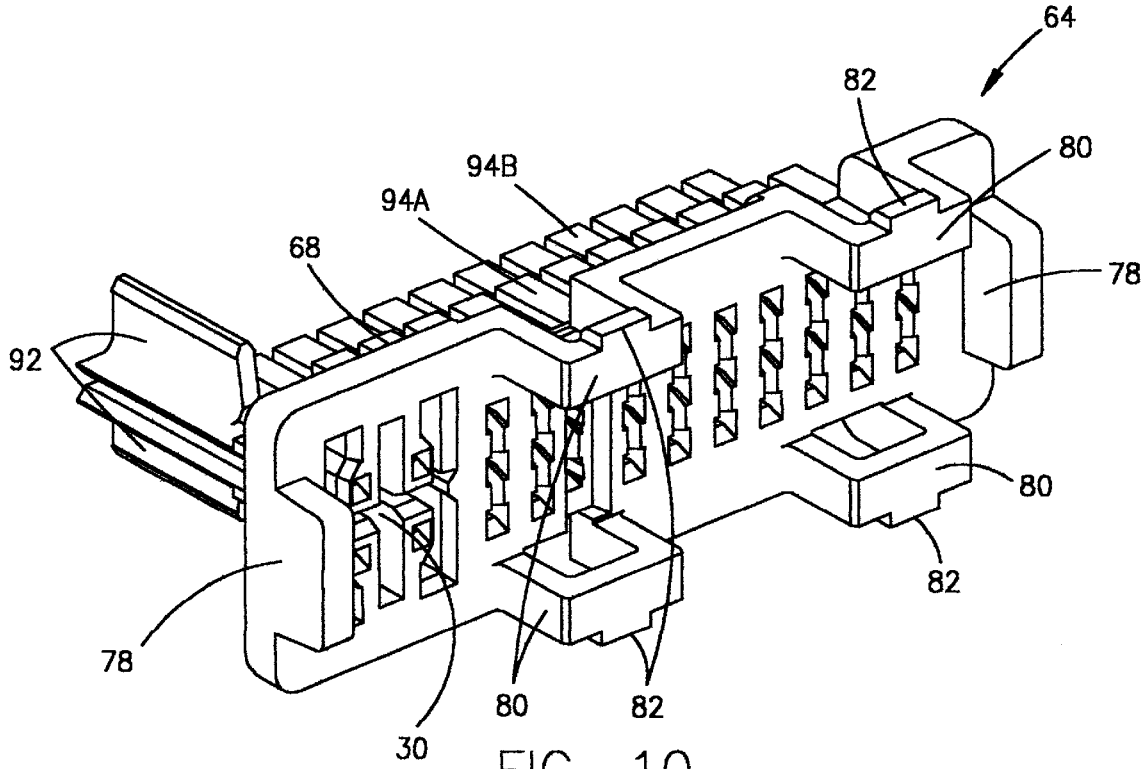
FIG. 10 is a front perspective view of the rear housing part.
Figure 11:
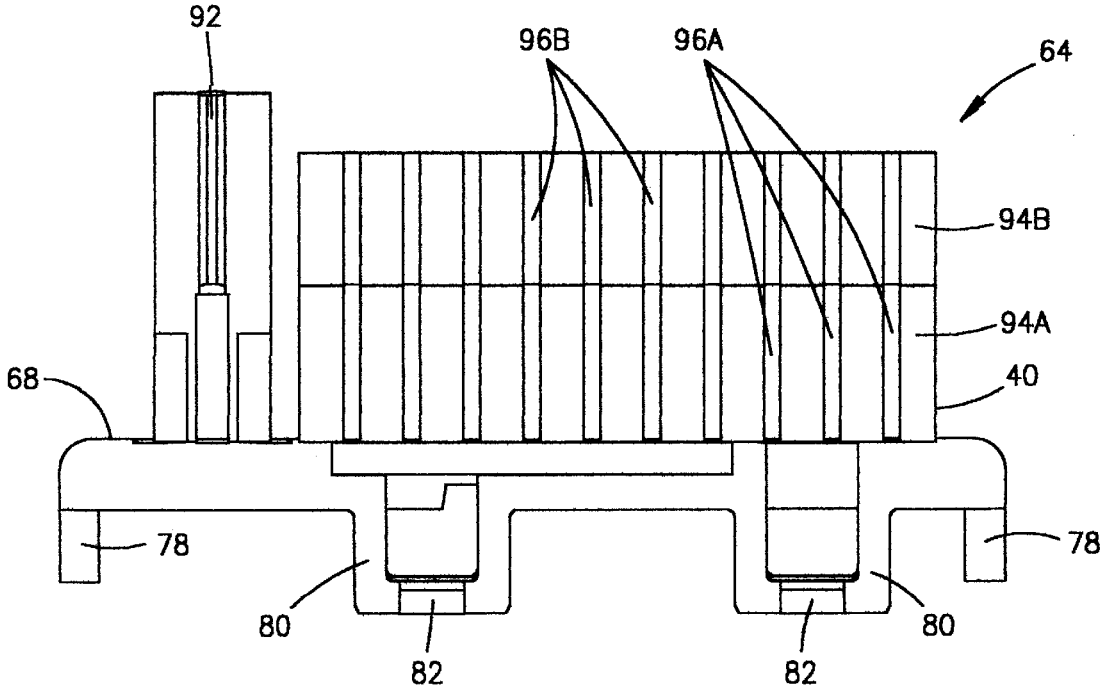
FIG. 11 is a top plan view of the rear housing part.
Figure 12:
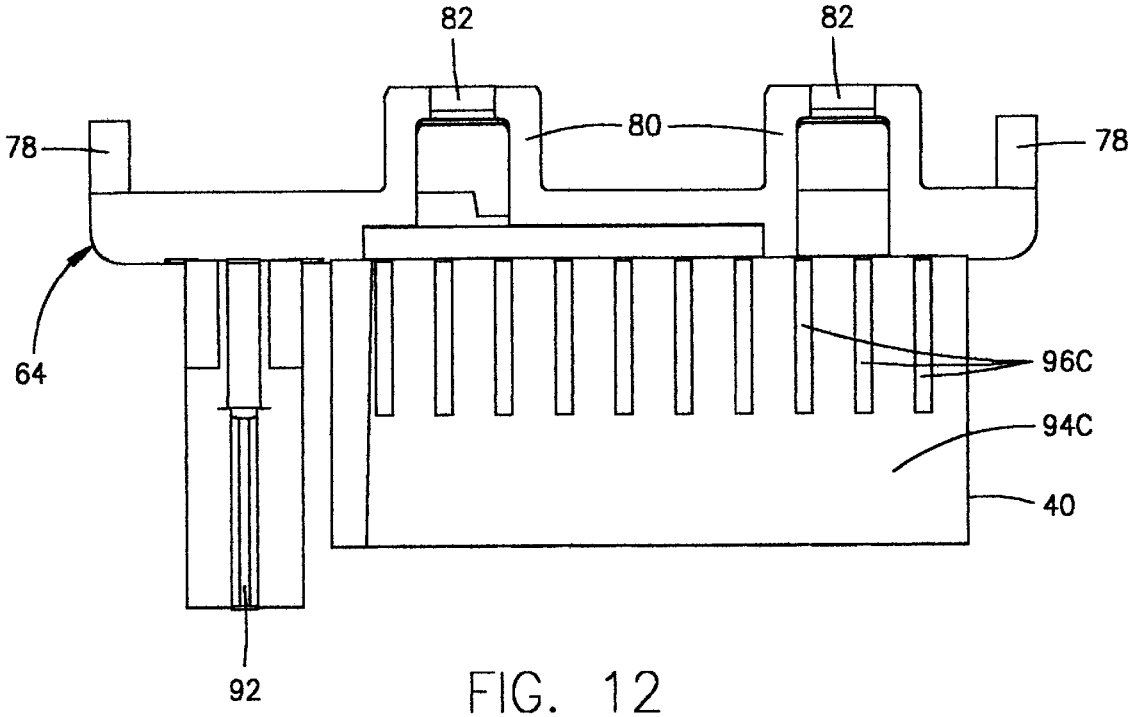
FIG. 12 is a bottom plan view of the rear housing part.

Referring to FIGS. 10–12 which show rear housing part 64 and FIGS. 8 and 9 which show the assembled connector, the invention contemplates a particular configuration of wire management platform 40 to facilitate connection of tail portions 36A–36C of terminals 24A–24C to the conductors of a plurality of discrete electrical wires. More particularly, the wire management platform projects rearwardly from rear face 68 of rear housing part 64. The platform includes a first top land or surface 94A at which tail portions 36A of the top row of terminals are juxtaposed as clearly shown in FIGS. 8 and 9. The platform includes a second top land or surface 94B offset from the first top surface and projecting further from rear face 68 than first top surface 94A, and at which tail portions 36B of the middle row of terminals are juxtaposed. As seen in FIGS. 8 and 9, as well as in FIG. 4, the tail portions of the middle row of terminals are longer than the tail portions of the top row of terminals. Finally, the platform includes a bottom land or surface 94C at which tail portions 36C of the bottom row of terminals are juxtaposed.

Figure 4:
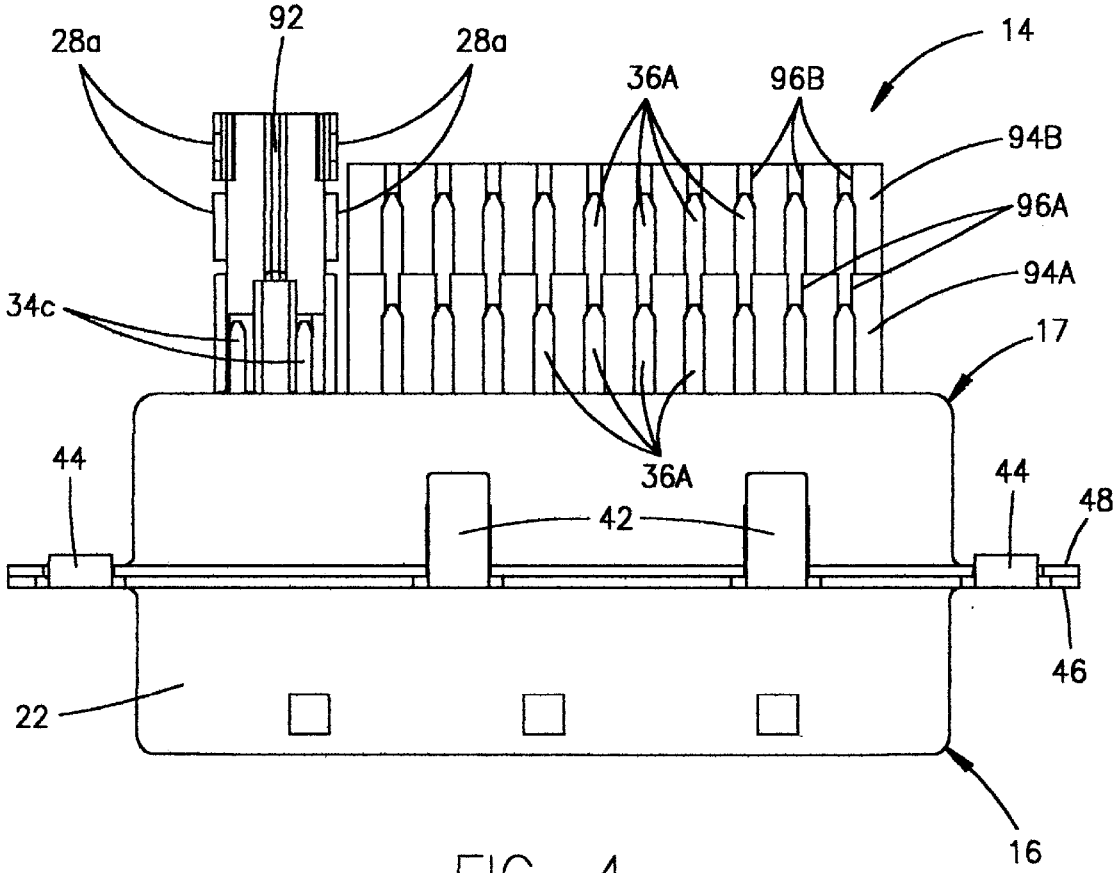
FIG. 4 is a top plan view of the connector.
Figure 5:
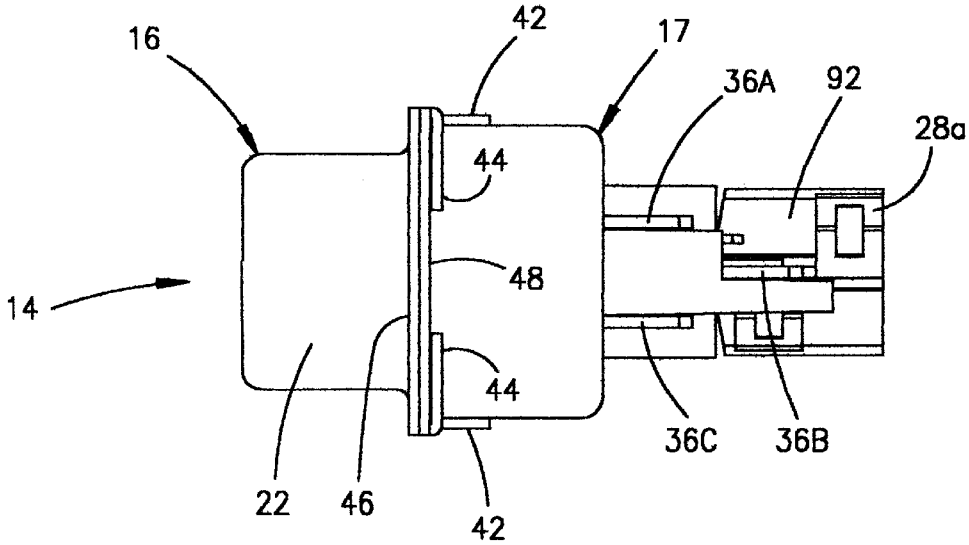
FIG. 5 is a side elevational view of the connector.

In order to further facilitate managing and terminating the tail portions of the terminals to the conductors of a plurality of discrete electrical wires, grooves 96A are formed in first top surface 94A in alignment with tail portions 36A of the top row of terminals as seen clearly in FIGS. 4, 8 and 9 as well as the top view of the rear housing part in FIG. 11. Grooves 96B are formed in second top surface 94B in alignment with tail portions 36B of the middle row of terminals. Grooves 96C are formed in bottom surface 94C as best seen in FIG. 12 in alignment with tail portions 36C (FIG. 5) of the bottom row of terminals. These grooves facilitate positioning the discrete electrical wires in alignment with the respective tail portions of the terminals, so that the center conductors of the wires can be laid immediately onto the tail portions for soldering purposes.

Figure 13:
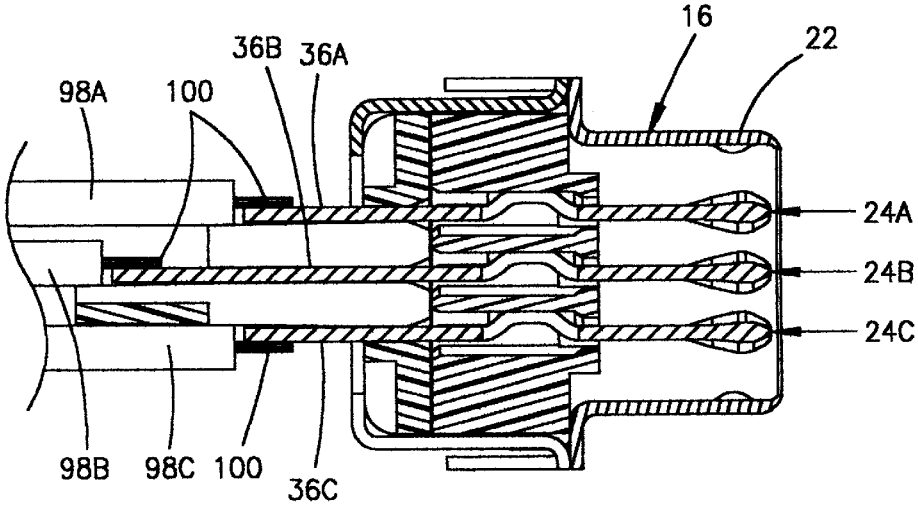
FIG. 13 is a front-to-rear section through the connector, with the conductors of three electrical wires terminated to the tail portions of terminals in the three rows thereof.

This is seen in the sectional view of FIG. 13, wherein an electrical wire 98A is shown with a conductor 100 on top of the tail portion 36A of one of the terminals 24A in the top row thereof. Another wire 98B is shown with its conductor 100 on top of the tail portion 36B of one of the terminals 24B in the middle row thereof. A third wire 98C is shown with its conductor 100 immediately below tail portion 36C of one of the terminals 24C in the bottom row thereof. The discrete wires are shown with a portion of their outer insulating sheaths removed to expose their conductors 100. The insulated wires are positioned in grooves 96A–96C, as described above, whereupon their respective conductors are positioned against tail portions 36A–36C as seen in FIG. 13, whereupon the conductors can be easily connected, as by soldering, to the tail portions of the terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

an elongated dielectric housing having a central body portion with a front face, a rear face and at least three rows of terminal-receiving passages extending therebetween and including a top row, a middle row and a bottom row;

a plurality of terminals received in said passages and including top terminals received in at least some of the passages in said top row, middle terminals received in at least some of the passages in the middle row and bottom terminals received in at least some of the passages in the bottom row, all of the terminals having forward contact portions and tail portions projecting rearwardly from the body portion beyond said rear face thereof, and the tail portions of the middle terminals being longer than the tail portions of the top terminals; and a wire management platform projecting from the rear face of said central body portion, the platform including a first top surface at which the tail portions of the top terminals are juxtaposed, a second top surface offset from the first top surface and projecting further from the rear face of the body portion than the first top surface and at which the longer tail portions of the middle terminals are juxtaposed, and a bottom surface at which the tail portions of the bottom terminals are juxtaposed, said three surfaces facilitating connection of the tail portions of the terminals to the conductors of a plurality of discreet electrical wires.

2. The electrical connector of claim 1, including a plurality of grooves in at least one of said surfaces aligned with the tail portions juxtaposed thereat to facilitate aligning the electrical wires and respective conductors with the tail portions of the terminals.

3. The electrical connector of claim 1 wherein the platform second top surface projects from the rear face further rearward than the platform first top surface.

4. The electrical connector of claim 1 wherein the tail portions of the bottom terminals are shorter than the tail portions of the middle terminals.

5. The electrical connector of claim 1 wherein the dielectric housing includes a front housing part and a second housing part.

6. The electrical connector of claim 5 wherein the platform second top surface projects from the rear face further rearward than the platform first top surface.

7. The electrical connector of claim 6 including a front shield and a rear shield, the front shield including at least one tab to hold the front and rear housing parts together.

8. An electrical connector, comprising:

a two piece dielectric housing having a front housing part and a rear housing part, the front housing part including a central body having at least two rows of terminal-receiving passages extending through the front housing part, the rear housing part including a central body portion with a rear face and having at least two rows of terminal-receiving passages extending through the rear housing part, said at least two rows of terminal receiving passages in said front and rear housing parts including a top row and a bottom row;

a plurality of terminals received in said passages and including top terminals received in at least some of the passages in said top row and bottom terminals received in at least some of the passages in the bottom row, all of the terminals having forward contact portions and tail portions projecting rearwardly beyond said rear face of said rear housing part; and a wire management platform integral with and projecting from the rear face of said rear housing part, the platform including a top surface at which the tail portions of the top terminals are juxtaposed and a bottom surface at which the tail portions of the bottom terminals are juxtaposed, said two surfaces facilitating connection of the tail portions of the terminals to the conductors of a plurality of discreet electrical wires.

9. The electrical connector of claim 8, including a plurality of grooves in said surfaces aligned with the tail portions juxtaposed thereat to facilitate aligning the electrical wires and respective conductors with the tail portions of the terminals.

10. The electrical connector of claim 8 wherein the platform bottom surface projects from the rear face further rearward than the platform top surface.

11. The electrical connector of claim 8 including a front shield and a rear shield, the front shield including at least one tab to hold the front and rear housing parts together.

12. An electrical connector, comprising:

an elongated dielectric housing having a central body portion with a front face, a rear face and at least two rows of terminal-receiving passages extending therebetween and including a first row and a second row;

a plurality of terminals received in said passages and including first terminals received in at least some of the passages in said first row and second terminals received in at least some of the passages in the second row, all of the terminals having forward contact portions and tail portions projecting rearwardly from the body portion beyond said rear face thereof, and the tail portions of the second terminals being longer than the tail portions of the first terminals; and a wire management platform projecting from the rear face of said central body portion, the platform including a first top surface at which the tail portions of the first terminals are juxtaposed and a second top surface offset from the first top surface and projecting further from the rear face of the body portion than the first top surface and at which the longer tail portions of the second terminals are juxtaposed, said top surfaces facilitating connection of the tail portions of the terminals to the conductors of a plurality of discreet electrical wires.

13. The electrical connector of claim 12, including a plurality of grooves in at least one of said surfaces aligned with the tail portions juxtaposed thereat to facilitate aligning the electrical wires and respective conductors with the tail portions of the terminals.

14. The electrical connector of claim 12 wherein the platform second top surface projects from the rear face further rearward than the platform first top surface.

15. The electrical connector of claim 12 wherein the dielectric housing includes a front housing part and a second housing part.

16. The electrical connector of claim 15 wherein the platform second top surface projects from the rear face further rearward than the platform first top surface.

17. The electrical connector of claim 15 including a front shield and a rear shield, the front shield including at least one tab to hold the front and rear housing parts together.

18. An electrical connector, comprising:

a two piece dielectric housing having a front housing part and a rear housing part, the front housing part including a central body having at least one row of terminal-receiving passages extending through the front housing part the rear housing part including a central body portion with a rear face and having at least one row of terminal-receiving passages extending through the rear housing part;

a plurality of terminals received in said passages and including forward contact portions and tail portions projecting rearwardly beyond said rear face of said rear housing part; and a wire management platform integral with and projecting from the rear face of said rear housing part, and including a surface at which the tail portions of the terminals are juxtaposed, and a plurality of grooves in the surface aligned with the tail portions juxtaposed thereat to facilitate aligning electrical wires and respective conductors with the tail portions of the terminals.

19. The electrical connector of claim 18 including a front shield and a rear shield, the front shield including at least one tab to hold the front and rear housing parts together.

* * * * *